US007105286B2

(12) United States Patent
Nakamura

(10) Patent No.: US 7,105,286 B2
(45) Date of Patent: Sep. 12, 2006

(54) SILVER HALIDE PHOTOGRAPHIC MATERIAL

(75) Inventor: Takesi Nakamura, Hachioji (JP)

(73) Assignee: Konica Minolta Photo Imaging, Inc., Tokyo (JP)

( * ) Notice: Subject to any disclaimer, the term of this patent is extended or adjusted under 35 U.S.C. 154(b) by 0 days.

(21) Appl. No.: 10/534,607

(22) PCT Filed: Nov. 20, 2002

(86) PCT No.: PCT/JP02/12114

§ 371 (c)(1),
(2), (4) Date: May 11, 2005

(87) PCT Pub. No.: WO2004/046817

PCT Pub. Date: Jun. 3, 2004

(65) Prior Publication Data

US 2006/0024623 A1 Feb. 2, 2006

(51) Int. Cl.

| | |
|---|---|
| ***G03C 1/77*** | (2006.01) |
| ***G03C 1/85*** | (2006.01) |
| ***G03C 1/76*** | (2006.01) |
| ***G03C 1/06*** | (2006.01) |

(52) U.S. Cl. ..... 430/523; 430/502; 430/567; 430/607; 430/611; 430/525; 430/530; 430/531; 430/600; 430/603

(58) Field of Classification Search ..... 430/502, 430/503, 607, 611, 567, 523, 525, 531, 530, 430/600, 603

See application file for complete search history.

(56) References Cited

U.S. PATENT DOCUMENTS

| | | | | |
|---|---|---|---|---|
| 3,945,829 | A * | 3/1976 | Zorn et al. | 430/507 |
| 5,328,818 | A * | 7/1994 | Fukuzawa et al. | 430/505 |
| 5,382,506 | A | 1/1995 | Tosaka et al. | |
| 5,415,982 | A * | 5/1995 | Deguchi | 430/385 |
| 5,453,351 | A * | 9/1995 | Ueda et al. | 430/532 |
| 5,578,426 | A | 11/1996 | Nakamura | |
| 6,569,610 | B1 * | 5/2003 | Yoshida | 430/434 |

FOREIGN PATENT DOCUMENTS

| | | | |
|---|---|---|---|
| JP | 60-23849 | A | 2/1985 |
| JP | 5-61154 | A | 3/1993 |
| JP | 5-66519 | A | 3/1993 |
| JP | 7-230141 | A | 8/1995 |
| JP | 7-244356 | A | 9/1995 |
| JP | 7-248576 | A | 9/1995 |
| JP | 7-248578 | A | 9/1995 |
| JP | 7-248579 | A | 9/1995 |
| JP | 8-304960 | A | 11/1996 |
| JP | 9-5952 | A | 1/1997 |
| JP | 9-73150 | A | 3/1997 |
| JP | 9-73151 | A | 3/1997 |
| JP | 9-80688 | A | 3/1997 |
| JP | 10-123683 | A | 5/1998 |
| JP | 2000-39686 | A | 2/2000 |
| JP | 2000-338630 | A | 12/2000 |
| JP | 2001-337418 | A | 12/2001 |

* cited by examiner

*Primary Examiner*—Geraldine Letscher
(74) *Attorney, Agent, or Firm*—Frishauf, Holtz, Goodman & Chick, P.C.

(57) ABSTRACT

The present invention relates to a silver halide photographic material comprising a paper support having resin layers coated on both sides of a base paper, and in particular, to a silver halide photographic material exhibiting superior glossiness and improved sharpness, long-term stability, fingerprint resistance and pressure resistance. The silver halide photographic material comprising on one side of the paper support having resin coat layers on both sides of a base paper, one or more light-sensitive layers and one or more light-insensitive layers, wherein after the photographic material of an L-size (having a length of 89 mm in a machine direction of the base paper and a length of 127 mm vertical to the machine direction) is processed, the photographic material exhibits an image clarity (C-value) of 20% to 60% which is determined using a 1.0 mm optical wedge in accordance with JIS K 7105; and the photographic material comprising a light-insensitive hydrophilic colloid layer between a light-sensitive layer closest to the support and the support.

13 Claims, No Drawings

SILVER HALIDE PHOTOGRAPHIC MATERIAL

This application is the United States national phase application of International Application PCT/JP2002/012114 filed Nov. 20, 2002.

TECHNICAL FIELD

The present invention relates to a silver halide photographic material having a paper support having resin layers coated on both sides of a base paper, and in particular, to a silver halide photographic material exhibiting superior glossiness and improved sharpness, long-term stability, fingerprint resistance and pressure resistance.

TECHNICAL BACKGROUND

Recently, in the field of silver halide photographic materials, requirements for images of further high quality have been increased along with spread of color photographic materials. In such a situation, studies of color reproduction, stability, enhancement of sharpness, glossiness and the like have been made more broadly than ever in silver halide photographic materials used for color prints, so-called color paper.

There are generally known irradiation and halation as a factor affecting sharpness. The former is brought about by incident light scattered by silver halide grains or oil droplets of a coupler or the like, dispersed in gelatin film, the extent of which is mainly dependent of gelatin content, silver halide content and oil droplet content; the latter is dependent of the extent of light reflection from the support, depending on reflectance or refractive index of the support.

There are known methods of providing, an antihalation layer to prevent halation. Improvements thereof are described, for example, in JP-A Nos. 55-33172, 59-193447, 59-151650 and 62-33448 (hereinafter, the term, JP-A refers to Japanese Patent Application Publication). However, these methods cause a marked lowering in sensitivity along with enhanced sharpness so that it was difficult to achieve enhanced sharpness with maintaining practically sufficient sensitivity by only such a means.

There have been studied improvements of supports. Recently, for the purpose of shortening the processing time, a water-resistant support in which the substrate paper surface is laminated with polyolefin resin or the like, and so-called RC paper has been used as a support for color print photographic material, in which to enhance sharpness and whiteness, white pigments such as titanium oxide are dispersed in the polyolefin resin layer on the emulsion layer side of the support. To enhance sharpness, as disclosed in JP-A Nos. 54-46035, 64-18144 and 2-71256, it was effective to combine a technique of using RC paper in which a white pigment was filled at a much more amount in the polyolefin resin layer of the emulsion-coated side. However, there were disadvantages such as a lowering of smoothness of the polyethylene layer surface and deteriorated adhesion between the polyethylene layer and the emulsion layer.

Apparent glossiness is related to "image clarity" the measurement of which is defined in JIS K 7105 and JIS H8686 and photographic prints exhibiting high image clarity are strongly desired. Low image clarity results in a quality deficient in high-grade feel. On the contrary, high image clarity in the case of color paper can obtain prints with glossy feeling, which is liked by general users. However, strong gloss due to light reflection often makes it difficult to observe printed images. Further, because of a high smoothness, for example, adhesion of fingerprints becomes easy in the course of preparing prints or when people observe photographic prints with taking them in hands, resulting in eventual deteriorated quality.

Silver halide photographic materials are treated under various environments and requirements for storage stability or physical properties of photographic prints have increased. For example, there was a problem that when some pressure is continuously applied streakily onto the surface of color paper during the course of handling and after the color paper is processed, streaky pressure marks are produced only on the pressure-applied portion, and it remains a strong desire to overcome such problems.

There was also proposed a method in which a hydrophilic colloid layer containing a white pigment is provided between the support of a silver halide photographic material and a silver halide emulsion layer to improve rapid processability, sharpness, sensitivity stability and dye forming ability (as described, for example, in patent documents 1 to 4).

However, any one of the proposed methods described above is mainly directed toward improvement of sharpness or improvement of process stability under an environment of rapid access and nothing is taught or suggested with respect to the foregoing problems, such as image clarity, storage stability and pressure resistance.

Patent document 1:
JP-A No. 6-35149 (scope of patent claims)
Patent document 2:
JP-A No. 7-134358 (scope of patent claims)
Patent document 3:
JP-A No. 8-272041 (scope of patent claims)
Patent document 4:
JP-A No. 8-304960 (scope of patent claims)

DISCLOSURE OF THE INVENTION

The foregoing object of the invention can be accomplished by the following constitutions.

(1) A silver halide photographic material comprising on one side of a paper support having resin coat layers on both sides of a base paper one or more light-sensitive layers and one or more light-insensitive layers, wherein after the photographic material of an L-size (having a length of 89 mm in a machine direction of the base paper and a length of 127 mm vertical to the machine direction) is processed, the photographic material exhibits an image clarity (C-value) of 20% to 60% which is determined using a 1.0 mm optical wedge in accordance with JIS K 7105; and the photographic material comprising a light-insensitive hydrophilic colloid layer between a light-sensitive layer closest to the support and the support.

(2) The silver halide photographic material described in (1), wherein the light-insensitive hydrophilic colloid layer contains a mercapto-heterocyclic compound.

(3) The silver halide photographic material described in (1), wherein the light-insensitive hydrophilic colloid layer contains a thiosulfonic acid compound.

(4) The silver halide photographic material described in (1), wherein the light-insensitive hydrophilic colloid layer contains a latex.

(5) The silver halide photographic material described in (1), wherein the light-insensitive hydrophilic colloid layer contains a lipophilic compound dispersion.

(6) The silver halide photographic material described in (1), wherein the light-insensitive hydrophilic colloid layer contains a titanium oxide.

(7) The silver halide photographic material described in (1), wherein the light-insensitive hydrophilic colloid layer contains a colloidal silver.

(8) The silver halide photographic material described in any of (1) to (7), wherein the light-sensitive layer closest to the support is a blue-sensitive layer containing silver halide grains having an average grain size of 0.35 to 0.60 μm.

PREFERRED EMBODIMENT OF THE INVENTION

As a result of studies of the foregoing problems, the present invention has come into being by finding that a silver halide photographic material comprising on one side of a paper support having resin coat layers on both sides of a base paper one or more light-sensitive layers and one or more light-insensitive layers, wherein after the photographic material of an L-size (having a length of 89 mm in a machine direction of the base paper and a length of 127 mm vertical to the machine direction) is processed, the photographic material exhibits an image clarity (C-value) of 20% to 60% which is determined using a 1.0 mm optical wedge in accordance with JIS K 7105, and the photographic material comprising a light-insensitive hydrophilic colloid layer between a light-sensitive layer closest to the support and the support, exhibits an appropriate glossiness and resulting in improved sharpness, long-term storage stability, fingerprint resistance and pressure resistance.

It was further found that the light-insensitive hydrophilic colloid layer between a light-sensitive layer closest to the support and the support containing a mercapto-heterocyclic compound, a thiosulfonic acid compound, a latex, a lipophilic compound dispersion, a titanium oxide or a colloidal silver resulted in further enhanced effects. It was also found that the use of silver halide grains having an average grain size of 0.35 to 0.60 μm in the blue-sensitive layer resulted in further enhanced effects.

The present invention will be described in detail.

One feature of the silver halide photographic material using the paper support having resin coat layers on both sides of a base paper is that after being processed, the photographic material of an L-size (having a length of 89 mm in the machine direction of the base paper and a length of 127 mm vertical to the machine direction) exhibits an image clarity (C-value) of 20% to 60% which can be determined using a 1.0 mm optical wedge in accordance with JIS K 7105.

First, there will be described a paper support having resin coat layers on both sides of a base paper.

The paper support having resin-coated layers on both sides of a base paper is preferably a paper support laminated with polyolefin on both sides of the base paper, and more preferably a polyethylene-laminated paper support.

Base paper used for the paper support can be prepared using wood pulp as the main raw material and optionally a synthetic pulp such as polypropylene and synthetic fiber such as nylon or polyethylene. Examples of wood pulp include LBKP, LBSP, NBKP, NBSP, LDP, NDP, LUKP, and NUKP, and LBKP, NBSP, LBSP, NDP and LDP which have a relatively high short fiber content, are preferred, provided that the proportion of LBSP and/or LDP is preferably from 10% to 70% by weight.

Of the foregoing pulps, chemical pulp having a relatively low impurity content (such as sulfate pulp or sulfite pulp) is preferably used, and a pulp which has been subjected to a bleaching treatment to enhance whiteness, is also advantageous. Base paper may optionally incorporate sizing agents such as a higher fatty acid and alkylketene dimer, white pigments such as calcium carbonate, talc and titanium oxide, paper strength-enhancing agents such as starch, polyacrylamide and polyvinyl alcohol, fluorescent brighteners, moisture-retaining agents such as polyethylene glycol, dispersing agents and softening agents such as a quaternary ammonium salt.

The freeness of a pulp used in paper making is preferably from 200 to 500, as defined in CSF. With respect to fiber length after beating, the sum of 24-mesh residue and 42-mesh residue, as defined in JIS-P-8207 is preferably from 30% to 70% by weight; and the 4-mesh residue is preferably not more than 20% by weight. The weight of base paper is preferably from 30 to 250 g/m$^2$, and more preferably from 50 to 200 g/m$^2$. The thickness of the base paper is preferably from 40 250 μm. Base paper may be subjected to a calendering treatment to provide enhanced smoothness during or after paper-making. The density of base paper is generally from 0.7 to 1.2 g/cm$^3$ (JIS-P-8118). The stiffness of base paper is from 20 to 200 g based on the condition defined in JIS-P-8118. The base paper surface may be coated with a surface sizing agent and the same sizing agents as those incorporated to the base paper are usable as a surface sizing agent. The pH of base paper is preferably from 5 to 9 when determined by the hot-water extraction method defined in JIS-P-8113.

Polyethylene covering the surface or back surface of base paper is mainly comprised mainly of low density polyethylene (LDPE) and/or high density polyethylene (HDPE), and LLDPE (linear low density polyethylene) or polypropylene may be used partially. Specifically, in the polyethylene layer of the light-sensitive layer side, rutile or anatase type titanium oxide is preferably added into polyethylene to improve opacity or whiteness, as when used for the photographic print paper. The titanium oxide content is usually from 3% to 20% by weight, and preferably from 4% to 13% by weight, based on polyethylene.

Polyethylene-coated paper is usable as glossy paper, or matted or silk-finished one used in conventional photographic print paper, which is obtained by performing a so-called embossing treatment when coating polyethylene through extrusion onto the base paper surface.

With respect to polyethylene used on both sides of the base paper, the polyethylene layer thickness is usually 20 to 40 μm and 10 to 30 μm respectively for the light-sensitive layer side and the back layer side.

The foregoing polyethylene-coated paper support preferably has characteristics as below:

1. tensile: a strength defined in JIS=P-8113, preferably having 20 to 300N in the machine direction and 10 to 200N in the cross direction;

2. tear strength: preferably 0.1 to 20N in the machine direction and 2 to 20N in the cross direction, measured by the method defined in JIS-P-8116;

3. compression elastic modulus ≧98.1 Mpa;

4. surface Bekk smoothness: preferably 20 sec. or more for the glossy surface under the condition defined in JIS-P-8119, or it may be less than this value for the embossed surface;

5. surface roughness: the surface roughness defined JIS-P-0601 is preferably not more than 10 μm for maximum height per reference length of 2.5 mm;

6. opacity: at least 80%, preferably from 85% to 98%, when measured according to the method defined in JIS-P-8138;

7. whiteness: L*, a* and b*, defined in JIS-Z-8729 are preferably L*=80 to 95, a*=−3 to +5 and b*=−6 to +2;

8. surface glossiness: 60° specular glossiness defined in JIS-Z-8741 is preferably from 10% to 95%;

9. Clark stiffness: support having a Clark stiffness of preferably 50 to 300 $cm^2/100$ in the transport direction of the recording medium;

10. moisture content of core paper: usually from 2% to 100% by weight, preferably 2% to 6%, based the core paper.

In the invention, the silver halide photographic material comprising on the foregoing support at least one light-sensitive layer and at least one light-insensitive layer, characterized in that after the photographic material of an L-size (having a length of 89 mm in the machine direction of the base paper and a length of 127 mm vertical to the machine direction) is processed, the photographic material exhibits an image clarity (C-value) of 20% to 60% (preferably 20% to 50%, and more preferably 20% to 30%), which is determined using a 1.0 mm optical wedge in accordance with JIS K 7105. An image clarity (C-value) falling within this range, as defined above not only retains sufficient glossiness and a feel of high quality but also improves fingerprint resistance. Advantageous effects of the invention can be effectively displayed in the L-size having been cut to a length of 89 mm in the machine direction of the base paper and a length of 127 mm vertical to the machine direction.

With respect to image clarity (C-value), of image clarities defined in JIS K 7105, the value determined by a reflection method using 1.0 mm optical wedge is defined as a C-value, which is used as a measure of image clarity.

The image clarity defined in the invention represents performance of film surface to transform an image facing the film surface, which is a value indicating how accurately an incident image is reflected or projected on the image surface. The more accurately a reflection image is given with respect to an incident image, the higher the image clarity becomes, resulting in an increase in C-value. This C-value indicates combined effects of specular glossiness and surface smoothness. Thus, the higher the reflection degree or the higher the smoothness, the higher C value.

A method for achieving an image clarity (C-value) of 20% to 60% is not specifically limited and it can be achieved by an appropriate combination of a method of making an Sra value (surface average roughness) of a support 0.1 to 0.3 μm, a method of adding colloidal silica to a protective layer and the like.

One feature of the silver halide photographic material is that at least a light-insensitive layer is provided between a support and the light-sensitive hydrophilic colloid layer closest the support, whereby advantageous effects of the invention is fully displayed.

In the invention, the foregoing light-insensitive layer hydrophilic colloidal preferably contains a mercapto-heterocyclic compound.

The mercapto-heterocyclic compound is preferably a compound represented by the following formula (I):

formula (I)

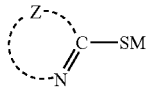

wherein Z is an atomic group necessary to form a 5- or 6-membered heterocyclic ring, or a 5- or 6-membered heterocyclic ring condensed with a benzene ring; M is a cation.

Examples of a 5- or 6-membered heterocyclic ring, or a 5- or 6-membered heterocyclic ring condensed with a benzene ring include a imidazole ring, a tetrazole ring, a thiazole ring, an oxazole ring, a benzothiazole ring, a benzotriazole ring, and a benzimidazole ring. Examples of a cation of M include hydrogen, sodium, potassium and ammonium cations. The a 5- or 6-membered heterocyclic ring, or the 5- or 6-membered heterocyclic ring condensed with a benzene ring may be substituted by a substituent. Examples of such a substituent include an alkyl group, an alkenyl group, an aryl group, a heterocyclic group, a halogen atom, an alkoxyl group, an aryloxy group, an alkoxycarbonyl group, an aryloxycarbonyl group, a sulfonamide group, a sulfamoyl group, an ureido group, an acyl group, a carbamoyl group, an amido group, a sulfonyl group, an amino group, nitro group, carboxyl group, and hydroxy group. These groups may be further substituted by substituents described above.

Specific examples of a mercapto-heterocyclic compound as shown below but are by no means limited to these.

I-1

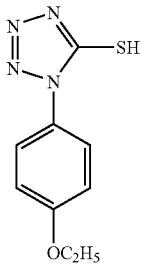

I-2

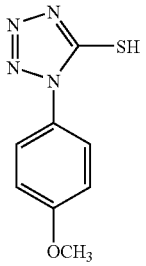

I-3

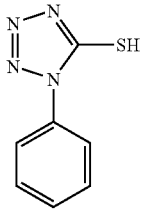

-continued

I-4

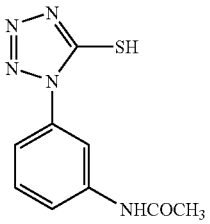

I-5

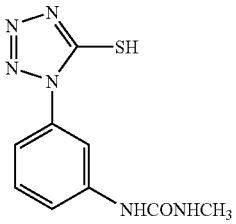

I-6

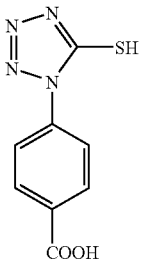

I-7

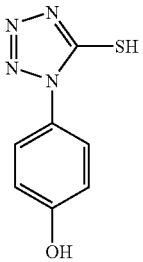

I-8

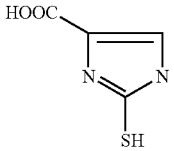

I-9

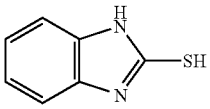

I-10

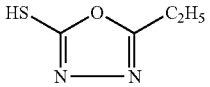

I-11

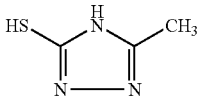

I-12

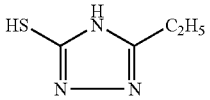

-continued

I-13

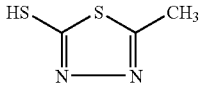

I-14

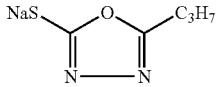

I-15

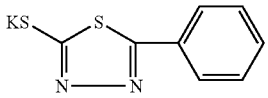

I-16

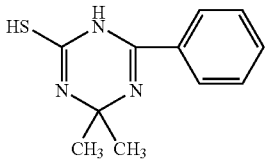

I-17

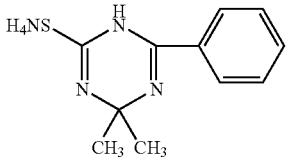

In the silver halide color photographic material of the invention, the light-insensitive hydrophilic colloid layer preferably contains a thiosulfonic compound.

Thiosulfonic compounds usable in the invention are preferably a compound represented by the following formula (II):

$$R_{21}—SO_2S—M_{21} \qquad \text{formula (II)}$$

The thiosulfonic acid compound represented by the foregoing formula (II) may be a free acid or its salt.

An aliphatic group represented by $R_{21}$ is preferably an alkyl group having 1 to 22 carbon atoms, or an alkenyl or alkynyl group having 2 to 22 carbon atom, and more preferably an alkyl group having 1 to 8 carbon atoms, or an alkenyl or alkynyl group having 3 to 5 carbon atom. These groups may be substituted. Examples of an alkyl group include methyl, ethyl, propyl, iso-propyl, butyl, t-butyl, 2-ethylhexyl, decyl, dodecyl, octyl and cyclohexyl. Examples of an alkenyl group include allyl and butenyl. Examples of an alkynyl group include propargyl and butynyl.

An aromatic group represented by $R_{21}$ is preferably an aromatic group having 6 to 20 carbon atoms, and more preferably an aromatic group having 6 to 10 carbon atoms. These groups may be substituted. Specific examples of these groups include a phenyl group, a p-tolyl group and a naphthyl group.

A heterocyclic group represented by $R_{21}$ is preferably a heterocyclic group having 3 to 15 carbon atoms and more preferably a 5- or 6-membered nitrogen containing heterocyclic group. Specific examples thereof include a pyrrolidine ring, a piperazine ring, a pyridine ring, a tetrahydrofuran ring, a thiophene ring, an oxazole ring, an imidazole ring, a benzothiazole ring, a tellurazole ring, an oxadiazole ring, and a thiadiazole ring.

Of the foregoing group represented by $R_{21}$, a substituted aromatic group having 6 to 10 carbon atoms is specifically preferred. Examples of a substituent include an alkyl group (e.g., methyl, ethyl, propyl, pentyl), an alkoxy group (e.g., e.g., methoxy, ethoxy), an aryl group (e.g., phenyl, naphthyl), hydroxy group, a halogen atom, an aryloxy group (e.g., phenoxy), an alkylthio group (e.g., methylthio, butylthio), an arylthio group (e.g., phenylthio), an acyl group (e.g., acetyl, propionyl), a sulfonyl group (e.g., methylsulfinyl, phenylsulfonyl), an acylamino group (e.g., acetylamino), a sulfonylamino group, an acyloxy group, carboxy group, cyano group, sulfo group and an amino group.

Specific examples of a thiosulfonic acid usable in the invention are shown below, but are not limited to these.

II-1

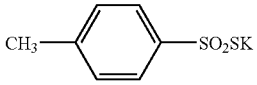

II-2

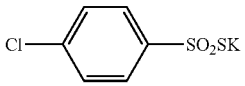

II-3

$C_4H_9SO_2SK$

II-4

$KSO_2S—(CH_2)_4—SO_2SK$

II-5

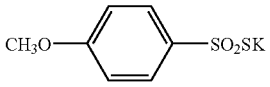

II-6

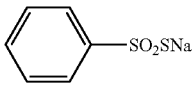

II-7

$C_4H_9SO_2K$

II-8

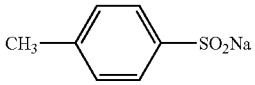

II-9

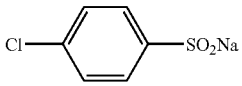

II-10

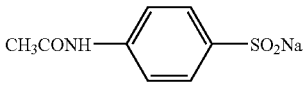

II-11

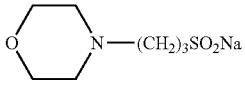

II-12

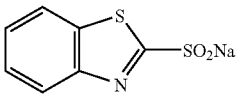

II-13

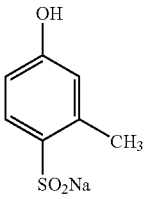

-continued

II-14

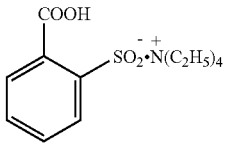

II-15

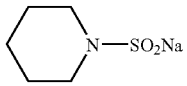

II-16

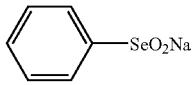

In the silver halide photographic material of the invention, the light-insensitive hydrophilic colloid layer preferably contains latex.

Latexes usable in the invention include commonly known polymer latexes. Examples of a preferred polymer include a homopolymer of an acrylic acid alkyl ester or its copolymer with acrylic acid or styrene, styrene-butadiene copolymer, and a polymer comprised of a monomer containing an active methylene group, a water-solubilizing group or a group capable of crosslinking with gelatin or its copolymer. To enhance affinity with gelatin as a binder, a copolymer of a hydrophobic monomer as a main component such as an acrylic acid alkyl ester or styrene and a monomer containing a water-solubilizing group or a group capable of crosslinking with gelatin is specifically preferred.

Preferred examples of a monomer containing a water-solubilizing group include acrylic acid, methacrylic acid, maleic acid, 2-acrylamido-2-methylpropanesulfonic acid and styrenesulfonic acid; preferred examples of a monomer containing a group capable of crosslinking with gelatin include glycidyl acrylate, glycidyl methacrylate and N-methylolacrylamide.

Polymer latex and its synthetic method are detailed in JP-A No. 2-41, U.S. Pat. Nos. 2,852,386, 2,853,457, 3,411,911, 3,411,912 and 4,197,127; JP-B Nos. 45-5331 and 60-18540 (hereinafter, the term, JP-B refers to Japanese Patent Publication). Examples thereof include a method of re-dispersing a polymer obtained by emulsion polymerization or solution polymerization.

In emulsion polymerization, for example, water is used as a dispersing medium, and monomers of 10% to 50% by weight, based on water, a polymerization initiator of 0.05% to 5% by weight, based on monomer and a dispersing agent of 0.1% to 20% by weight, based on monomer are used and polymerization is performed at 30° to 100° C., preferably 60° to 90° C. over a period of 3 to 8 hr, while stirring.

Examples of a polymerization initiator include a water-soluble peroxide and a water-soluble azo compound. Dispersing agents include, in addition to water-soluble polymers, for example, an anionic surfactant, nonionic surfactant, cationic surfactant and amphoteric surfactant, and these surfactants may be used alone or in their combination.

Specific examples of preferred polymer latexes usable in the invention are shown below but are not limited to these.

LA-1

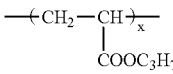

LA-2

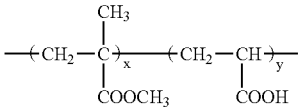

x:y = 96:4

LA-3

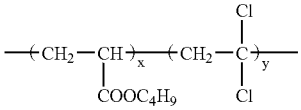

x:y = 97:3

LA-4

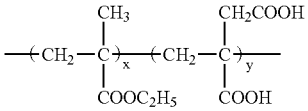

x:y = 98:2

LA-5

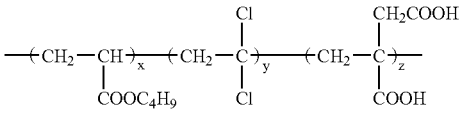

x:y:z = 80:16:4

LA-6

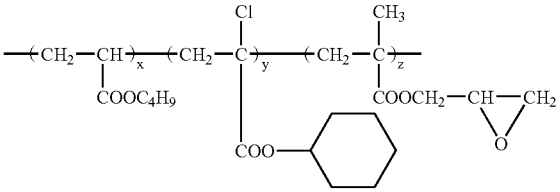

x:y:z = 60:30:10

LA-7

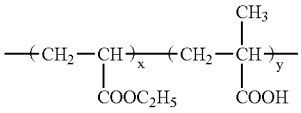

x:y = 95:5

The Tg (glass transition temperature)of a polymer forming a polymer latex usable in the invention is preferably not more than 40° C. The Tg of polymers can be referred in "Polymer Handbook" (1966, published by Wirey & Sons). The Tg (° K) of a copolymer can be represented by the following equation:

$$Tg\ (\text{copolymer})=v_1Tg_1+v_2Tg_2 \ldots v_wTg_w$$

wherein $v_1$, $v_2$, . . . $v_w$ each represent a weight fraction of a monomer(s) of a copolymer; $Tg_1$, $Tg_2$, . . . $T_w$ each represent a Tg) °K) of a homopolymer of the copolymer. The precision of Tg calculated by the foregoing equation is within ±5° C.

Any one of polymer latexes having an average particle size of 0.5 to 300 μm is suitably usable in the invention. The average particle size of a polymer latex can be determined by an electron micrograph method, a soap titration method, a light scattering method, and a centrifugal sedimentation method, as described in "Kobunshi-latex no Kagaku" (Chemistry of Polymer Latex, 1973, edited by Kobunshi-kankokai), and of these methods, a light scattering method is preferred. The molecular weight of a polymer is not specifically limited but the overall molecular weight is preferably from 1,000 to 1,000,000.

In the silver halide photographic material of the invention, the light-insensitive hydrophilic colloid layer preferably contains a lipophilic compound dispersion. The lipophilic compound dispersion refers to a dispersion of a compound exhibiting a solubility of not more than 3 g, preferably, not more than 1 g per 100 g of distilled water. The lipophilic compound usable in the invention is preferably a water-insoluble high-boiling organic compound, and more preferably an organic solvent exhibiting a boiling point of not less than 300° C. is more preferred. Herein, the boiling point refers to one at 101 kPa, and a high boiling solvent exhibiting a vapor pressure of not more than 66 Pa at 100° C. is preferred.

Examples of a water-insoluble high-boiling organic compound include phthalic acid esters, phosphoric acid esters, fatty acid esters, organic acid amides, ketones and hydrocarbons. Organic compounds H-1 to H-20 described in on page 34 of JP-A No. 1-156748 are also usable.

High boiling organic compound usable in the invention are preferably organic compounds having at least 20 carbon atoms (which may be branched or substituted by a substituent), more preferably organic compounds having at least 24 carbon atoms (which may be branched or substituted by a substituent), and saturated hydrocarbon compound (which may be branched or substituted by a substituent) are still more preferred and paraffins are specifically preferred.

Specific examples of a lipophilic compound are shown below but the invention is not limited to these.

O-1 di-n-octylphthalate
O-2 di-i-decylphthalate
O-3 di-n-nonylphosphate
O-4 di [ω-butyl-di(ethyloxy)]adipate
O-5 O-1 di-n-octylsebacate
O-6 glycerin triacetate
O-7 di-n-octylfumarate
O-8 trioctyl-trimeritate
O-9 tridecylphosphate
O-10 trioctyl-phosphineoxide
O-11 n-hexadecane
O-12 n-icosane
O-13 docasane
O-14 n-tetracosane
O-15 n-hexacosane
O-16 Sansocizer E-200 (Shinippon Rika Co., Ltd.)
O-17 Sansocizer E-1500A (Shinippon Rika Co., Ltd.)
O-18 liquid paraffin No. 150-S
(Sanko Kagaku Kogyo Co., Ltd.)

The foregoing lipophilic compounds may be used alone or in their combination. The lipophilic compound, together with commonly known organic solvents or water-soluble organic solvents is emulsified in a hydrophilic binder such as an aqueous gelatin solution, using a dispersing means, such as a mixer, a homogenizer, a colloid mill, a flow-jet mixer, or an ultrasonic homogenizer and then incorporated to the objective hydrophilic colloid layer.

The lipophilic compound is incorporated preferably in an amount of 5% to 200%, more preferably 10% to 100% by weight, based on a coating weight of a binder contained in the light-insensitive hydrophilic colloid layer.

In the silver halide photographic material of the invention, the light-insensitive hydrophilic colloid layer preferably contains a titanium oxide. Commonly known titanium oxides include three kinds of di-, tri- and tetra-valent as the valence number of titanium; a preferred compound used in the invention is preferably tetra-valent titanium oxide and specific examples thereof include rutile type titanium oxide, anatase type titanium oxide and their mixture. Titanium oxide usable in the invention can be synthesized by conventionally known methods or effects of the invention can be accomplished by the use of commercially available compounds. As a mean for synthesis, for example, titanium or titanic acid is strongly heated, vaporized to gas and sprayed while exposed to steam, whereby fine-particulate titanium oxide can be obtained.

Although non-treated titanium oxide which has not been subjected to a surface treatment may be employed, there may also be employed a surface-treated titanium oxide which has been surface-treated with various inorganic compounds such as aluminum hydroxide, silicon dioxide, zirconium oxide or magnesium hydroxide; a surface-treated titanium oxide which has been with various organic compounds such as alcohols, surfactants, siloxane or silane coupling agents; and a titanium oxide which has been subjected to an organic surface treatment and an inorganic surface treatment in combination.

In the silver halide photographic material, the light-insensitive hydrophilic colloid layer preferably contains colloidal silver and black colloidal silver is specifically preferred.

Of the foregoing colloidal silver, for example, black colloidal silver can be obtained in such a manner that silver nitrate is reduced in the presence of a reducing agent such as hydroquinone, phenidone, ascorbic acid, pyrogallol or dextrin under alkaline conditions, then, neutralized and cooled to set gelatin, thereafter, the reducing agent or unwanted soluble salts are removed by a noodle washing method. When reduced under alkaline conditions, preparing colloidal silver particles in the presence of an azaindene compound or a mercapto compound results in a uniform particulate colloidal silver dispersion.

To enhance effects of the invention, colloidal silver is incorporated preferably in an amount of at least 0.02 g/m$^2$, more preferably at least 0.05 g/m$^2$, and still more preferably at least 0.10 g/m$^2$.

In addition to the foregoing constitution, it is preferred that the light-sensitive layer closest to the support is a blue-sensitive layer, which contains silver halide grains having an average grain size of 0.35 to 60 μm.

In the invention, specifically, enhanced sharpness can be achieved by the lowest constituent layer as defined above.

In addition to the foregoing, constituent elements usable in the invention include, for example, a silver halide emulsion, additives for emulsion, a sensitization method, an antifoggant, a stabilizer, an antiirradiation dye, a fluorescent brightener, an yellow coupler, a magenta coupler, a cyan coupler, a sensitizing dye, a emulsion dispersing method, a surfactant, an antistaining agent, a binder, a hardener, a lubricant, a matting agent, a support, a blueing or red-coloring agent, a coating method, an exposure method, a color developing agent and processing agents, which are also included as compounds and methods described in from paragraph No. 0044 at line 22 of right column on page 9 to paragraph No. 0106 at line 17 of right column on page 14 of JP-A No. 11-347615.

Next, the present invention will be described based on examples but embodiments of the invention are by no means limited to these.

EXAMPLE 1

Preparation of Silver Halide Photographic Material

Preparation of Sample 101

There was prepared a support A laminated, on both sides of paper support of a weight of 170 g/m$^2$, with polyethylene, provided that the side to be coated with an emulsion layer was laminated with polyethylene melt containing surface-treated anatase type titanium oxide in an amount of 15% by weight and the opposite side of the paper support to the emulsion layer was laminated with polyethylene at 25 g/m$^2$. The support A was subjected to corona discharge and further thereon, the following component layers were provided to prepare a silver halide photographic material sample 101.

Preparation of Coating Solution

1st Layer coating solution:

To 23.4 g of yellow coupler (Y-1), 3.34 g of dye image stabilizer (ST-1), 3.34 goof dye image stabilizer (ST-2), 3.34 g of dye image stabilizer (ST-5), 0.34 g of antistaining agent (HQ-1), 5.0 g of image stabilizer A, 3.33 g of high boiling organic solvent (DBP) and 1.67 g of high boiling solvent (DNP) was added 60 ml of ethyl acetate. Using an ultrasonic homogenizer, the resulting solution was dispersed in 220 ml of an aqueous 10% gelatin solution containing 7 ml of an aqueous 20% surfactant (SU-1) solution to obtain a yellow coupler dispersion. The obtained dispersion was mixed with a blue-sensitive silver halide emulsion prepared as below to prepare a 1st layer coating solution.

2nd to 7th layer coating solution:

Coating solutions for the 2nd layer to 7th layer were each prepared similarly to the 1st layer coating solution, and the respective coating solutions were coated so as to have a coating amount as shown below.

Constitution of sample 101:

| | g/m$^2$ |
|---|---|
| 7th Layer (Protective layer) | |
| Gelatin | 1.00 |
| DBP | 0.002 |
| DIDP | 0.002 |
| Silicon dioxide | 0.003 |
| 6th Layer (UV absorbing layer) | |
| Gelatin | 0.40 |
| AI-1 | 0.01 |
| UV absorbent (UV-1) | 0.12 |
| UV absorbent (UV-2) | 0.04 |
| UV absorbent (UV-3) | 0.16 |
| Antistaining agent (HQ-5) | 0.04 |
| PVP | 0.03 |
| 5th Layer (Red-sensitive layer) | |
| Gelatin | 1.30 |
| Red-sensitive emulsion (Em-R) | 0.21 |
| Cyan coupler (C-1) | 0.25 |
| Cyan coupler (C-2) | 0.08 |
| Dye image stabilizer (ST-1) | 0.10 |
| Antistaining agent (HQ-1) | 0.004 |
| DBP | 0.10 |
| DOP | 0.20 |
| 4th Layer (UV absorbing layer) | |
| Gelatin | 0.94 |
| UV absorbent (UV-1) | 0.28 |

-continued

| Constitution of sample 101: | g/m$^2$ |
|---|---|
| UV absorbent (UV-2) | 0.09 |
| UV absorbent (UV-3) | 0.38 |
| AI-1 | 0.02 |
| Antistaining agent (HQ-5) | 0.10 |
| 3rd Layer (Green-sensitive layer) | |
| Gelatin | 1.30 |
| AI-2 | 0.01 |
| Green-sensitive Emulsion (Em-G) | 0.14 |
| Magenta coupler (MI-1) | 0.20 |
| Dye image stabilizer (ST-3) | 0.20 |
| Dye image stabilizer (ST-4) | 0.17 |
| DIDP | 0.13 |
| DBP | 0.13 |
| 2nd Layer (Interlayer) | |
| Gelatin | 1.20 |
| AI-3 | 0.01 |
| Antistaining agent (HQ-2) | 0.03 |
| Antistaining agent (HQ-3) | 0.03 |
| Antistaining agent (HQ-4) | 0.05 |
| Antistaining agent (HQ-5) | 0.23 |
| DIDP | 0.04 |
| DBP | 0.02 |
| Brightener (W-1) | 0.10 |
| 1st Layer (Blue-sensitive layer) | |
| Gelatin | 1.20 |
| Blue-sensitive Emulsion (Em-B) | 0.26 |
| Yellow coupler (Y-1) | 0.70 |
| Dye image stabilizer (ST-1) | 0.10 |
| Dye image stabilizer (ST-2) | 0.10 |
| Antistaining agent (HQ-1) | 0.01 |
| Image stabilizer (ST-5) | 0.10 |
| Image stabilizer A | 0.15 |
| DNP | 0.05 |
| DBP | 0.10 |
| Support | |
| Polyethylene-laminated paper (containing a slight amount of colorant) | |

The amount of silver halide was represented by an equivalent converted to silver. Additives used in sample 101 are as follows.

SU-1: Sodium tri-I-propylnaphthalenesulfonate

SU-2: Sodium di-(2-ethylhexyl)sufosuccinate

DBP: Dibutyl phthalate

DNP: Dinonyl phthalate

DOP: Dioctyl phthalate

DIDP: Diisodecyl phthalate

PVP: Polyvinylpyrrolidone

H-A: 2,4-Dichloro-6-hydroxy-s-triazine sodium salt

HQ-1: 2,5-Di-t-octylhydroquinone

HQ-2: 2,5-Di-sec-dodecylhydroquinone

HQ-3: 2,5-Di-sec-tetradecylhydroquinone

HQ-4: 2-sec-Dodecyl-5-sec-tetradecylhydoquinone

HQ-5: 2,5-Di(1,1-dimethyl-4-hexyloxycarbonyl)-butylhydroqinone

Image stabilizer A: p-t-Octylphenol

To each of the foregoing coating solutions, surfactant (SU-2) was added as a coating aid to adjust surface tension.

Y-1

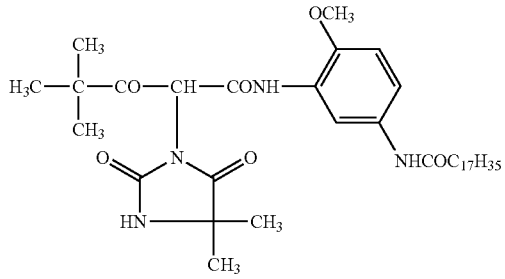

M-1

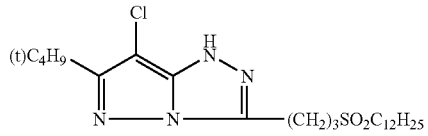

C-1

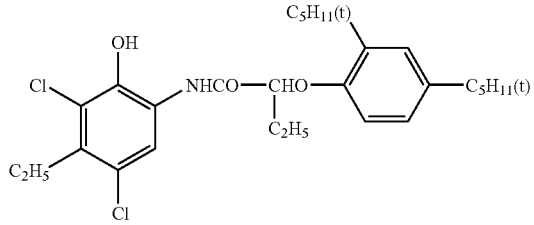

C-2

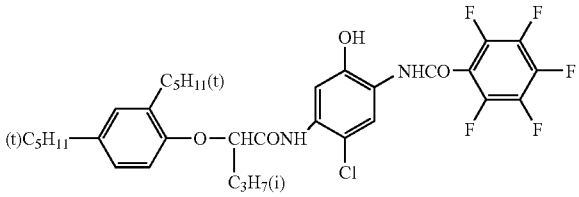

UV-1

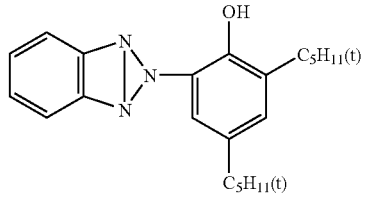

UV-2

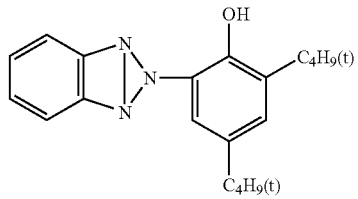

-continued

UV-3

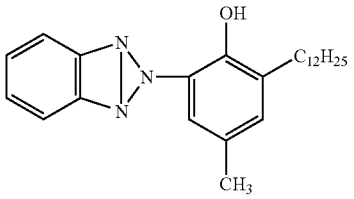

AI-1

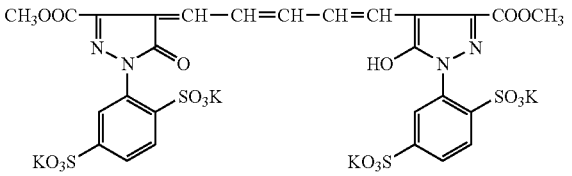

AI-2

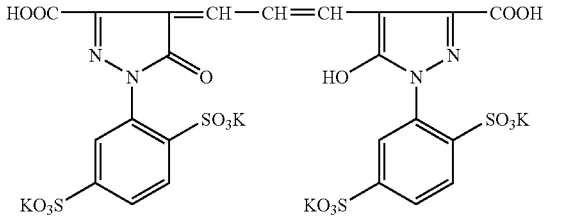

AI-3

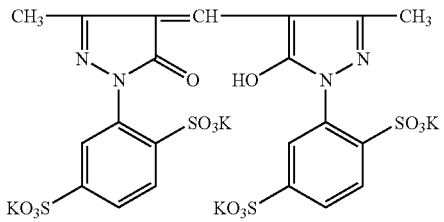

W-1

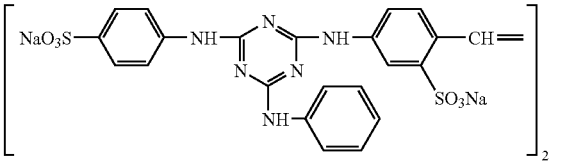

Preparation of blue-sensitive silver halide emulsion

To 1 liter of aqueous 2% gelatin solution kept at 40° C. were simultaneously added the following solutions (A) and (B) over a period of 30 min., while being maintained at a pAg of 7.3 and pH of 3.0, and further thereto were added solutions (C) and (D) for a period of 180 min., while being maintained at a pAg of 8.0 and pH of 5.5. The pAg was controlled according to the method described in JP-A No. 59-45437 and the pH was controlled using aqueous sulfuric acid or sodium hydroxide solution.

| | | |
|---|---|---|
| Solution A | | |
| Sodium chloride | 3.42 | g |
| Potassium bromide | 0.03 | g |
| Water to make | 200 | ml |
| Solution B | | |
| Silver nitrate | 10 | g |
| Water to make | 200 | ml |

-continued

| | | |
|---|---|---|
| Solution C | | |
| Sodium chloride | 102.7 | g |
| $K_2IrCl_6$ | $4 \times 10^{-8}$ | mol/mol Ag |
| $K_4Fe(CN)_6$ | $2 \times 10^{-5}$ | mol/mol Ag |
| Potassium bromide | 1.0 | g |
| Water to make | 600 | ml |
| Solution D | | |
| Silver nitrate | 300 | g |
| Water to make | 600 | ml |

After completing the addition, the resulting emulsion was desalted using a 5% aqueous solution of Demol N (produced by Kao-Atlas) and aqueous 20% magnesium sulfate solution, and re-dispersed in a gelatin aqueous solution to obtain a monodisperse cubic grain emulsion (EMP-1) having an average grain size of 0.71 μm, a coefficient of variation of grain size of 0.07 and a chloride content of 99.5 mol %. Monodisperse-cubic grain emulsions, EMP-1) having an average grain size of 0.64 μm, a coefficient of variation of grain size of 0.07 and a chloride content of 99.5 mol % was prepared similarly to EMP-1, provided that the addition time of Solutions A and B and the addition time of Solutions C and D were respectively varied.

The thus obtained emulsion, EMP-1 was chemically sensitized at 60° C. using the following compounds. Similarly, emulsion EMP-1B was chemically sensitized. These emulsions EMP-1 and EMP-1B were blended in a ratio of 1:1 to obtain a blue-sensitive silver halide emulsion (Em-B).

| | | |
|---|---|---|
| Sodium thiosulfate | 0.8 | mg/mol AgX |
| Chloroauric acid | 0.5 | mg/mol AgX |
| Stabilizer STAB-1 | $3 \times 10^{-4}$ | mol/mol AgX |
| Stabilizer STAB-2 | $3 \times 10^{-4}$ | mol/mol AgX |
| Stabilizer STAB-3 | $3 \times 10^{-4}$ | mol/mol AgX |
| Sensitizing dye BS-1 | $4 \times 10^{-4}$ | mol/mol AgX |
| Sensitizing dye BS-2 | $1 \times 10^{-4}$ | mol/mol AgX |

Preparation of Green-Sensitive silver halide Emulsion

Monodisperse cubic grain emulsion, EMP-2 having an average grain size of 0.40 μm, a coefficient of variation of grain size of 0.08 and a chloride content of 99.5 mol % was prepared similarly to EMP-1, provided that the addition time of Solutions A and B and the addition time of Solutions C and D were respectively varied. Monodisperse cubic grain emulsion, EMP-2B having an average grain size of 0.50 μm, a coefficient of variation of grain size of 0.08 and a chloride content of 99.5 mol % was prepared similarly to EMP-1, provided that the addition time of Solutions A and B and the addition time of Solutions C and D were respectively varied.

The thus obtained emulsion, EMP-2 was chemically sensitized at 55° C. using the following compounds. Similarly, emulsion EMP-2B was chemically sensitized. These emulsions EMP-2 and EMP-2B were blended in a ratio of 1:1 to obtain a blue-sensitive silver halide emulsion (Em-G).

| | | |
|---|---|---|
| Sodium thiosulfate | 1.5 | mg/mol AgX |
| Chloroauric acid | 1.0 | mg/mol AgX |
| Stabilizer STAB-1 | $3 \times 10^{-4}$ | mol/mol AgX |
| Stabilizer STAB-2 | $3 \times 10^{-4}$ | mol/mol AgX |

-continued

| | |
|---|---|
| Stabilizer STAB-3 | $3 \times 10^{-4}$ mol/mol AgX |
| Sensitizing dye GS-1 | $4 \times 10^{-4}$ mol/mol AgX |

Preparation of Red-Sensitive silver halide Emulsion

Monodisperse cubic grain emulsions, EMP-3 having an average grain size of 0.40 μm, a coefficient of variation of grain size of 0.08 and a chloride content of 99.5 mol % was prepared similarly to EMP-1, provided that the addition time of Solutions A and B and the addition time of Solutions C and D were respectively varied. Monodisperse cubic grain emulsions, EMP-3B having an average grain size of 0.38 μm, a coefficient of variation of grain size of 0.08 and a chloride content of 99.5 mol % was prepared similarly.

The thus obtained emulsion, EMP-3 was chemically sensitized at 60° C. using the following compounds. Similarly, emulsion EMP-3B was chemically sensitized. These emulsions EMP-3 and EMP-3B were blended in a ratio of 1:1 to obtain a red-sensitive silver halide emulsion (Em-R).

| | |
|---|---|
| Sodium thiosulfate | 1.8 mg/mol AgX |
| Chloroauric acid | 2.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye RS-1 | $1 \times 10^{-4}$ mol/mol AgX |
| Sensitizing dye RS-2 | $1 \times 10^{-4}$ mol/mol AgX |

Stabilizer STAB-1: 1-(3-acetoamidophenyl)-5-mercaptotetrazole

Stabilizer STAB-2: 1-phenyl-5-mercaptotetrazole

Stabilizer STAB-3: 1-(4-ethoxyphenyl)-5-mercaptotetrazole

To the red-sensitive emulsion, SS-1 was added in an amount of $2.0 \times 10^{-3}$ mol per mol of silver halide.

BS-1

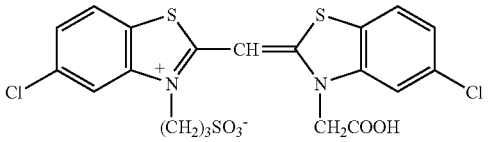

BS-2

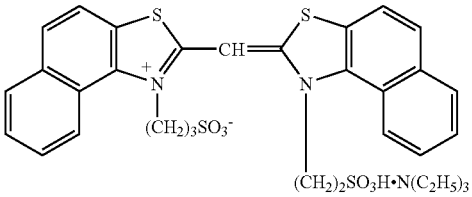

GS-1

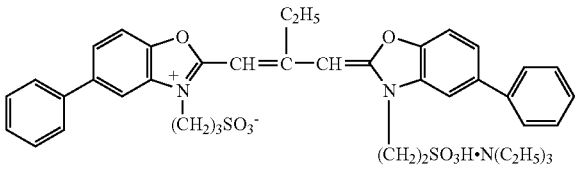

-continued

RS-1

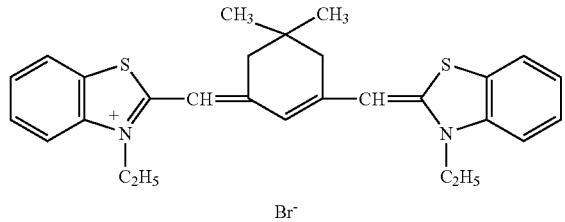

RS-2

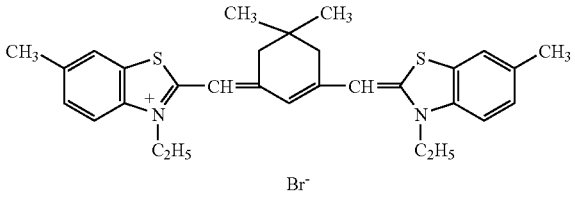

SS-1

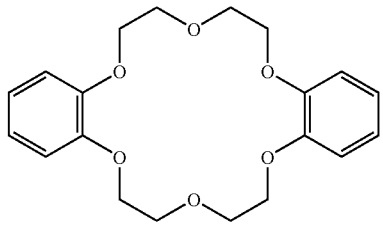

In the preparation of sample 101, hardener H-A was added to the 7th layer in an amount of 83 mg/m$^2$.

Preparation of Sample 102

Sample 102 was prepared similarly to sample 101, except that the support A was replaced by support B in which the light-sensitive layer side of the support was laminated by polyethylene of 20 g/m$^2$.

Preparation of Sample 103

Sample 103 was prepared similarly to the foregoing sample 102, except that a light-insensitive hydrophilic colloid layer comprised of gelatin in an amount of 0.7 g/m$^2$ (hereinafter, also denoted as 0-layer) was provided between the support B and the 1st layer, blue-sensitive layer.

Preparation of Samples 104 to 109

Samples 104 to 109 were prepared similarly to the foregoing sample 103, except that a compound described below was added to the 0-layer.

Sample 104: exemplified compound I-4 (mercapto-heterocyclic compound) was added in an amount of $7 \times 10^{-4}$ mol per mol of blue-sensitive silver halide emulsion of the 1st layer;

Sample 105: exemplified compound II-1 (thiosulfonic acid compound) was added in an amount of $7 \times 10^{-4}$ mol per mol of blue-sensitive silver halide emulsion of the 1st layer;

Sample 106: exemplified compound LA-1 (latex) was added in an amount of 0.07/m$^2$;

Sample 107: exemplified compound O-18 (liquid paraffin) was added in an amount of 0.07/m$^2$;

Sample 8: anatase type titanium oxide (average particle size: 0.2 μm) was added in an amount of 0.07/m$^2$;

Sample 109: a dispersion of black colloidal silver was added in a silver amount of 0.7 g/m$^2$;

Preparation of Sample 110

Sample 110 was prepared similarly to sample 103, except that monodisperse cubic grain emulsion EMP-1B (average grain size of 0.64 μm) was replaced by monodisperse cubic grain emulsion EMP-1C (average grain size of 0.45 μm).

Evaluation of Silver Halide Photographic Material

Thus prepared samples 101 to 110 were each evaluated in the following manner.

Evaluation of Image Clarity

Samples were each exposed to white light and processed in process A and the obtained black prints were each cut to a L-size having a length of 89 mm in the machine direction of the base paper and a length of 127 mm vertical to the machine direction, and an image clarity was determined using 1.0 mm optical wedge, by an image clarity measurement apparatus (produced by Suga Shikenki Co.,) based on JIS K 7105. It was proved that higher image clarity indicates higher glossiness.

Evaluation of Fingerprint Resistance

Fingerprints were randomly adhered with a forefinger onto five portions of each of the prints used in the evaluation of image clarity and adherence of fingerprints onto the print surface was evaluated based on the following criteria:

A: no fingerprint was observed when looking from right above the print,

B: no fingerprint was observed when looking from right above the print but fingerprints were evident when looking at varying viewing angles, C: fingerprints were apparent even when looking from right above a print.

Evaluation of Long-term Storage Stability

Samples were allowed to stand for 3 weeks under an environment of 40° C. and 40% RH and samples were also aged for 3 weeks in a freezer. Thereafter, both samples, without photographic exposure were processed according to process A described below. Using an X-rite 310 densitometer (produced by X-rite Corp.), processed samples were measured with respect to yellow density (fog density) to determine the difference in density (ΔD) between a sample aged for 3 weeks at 40° C. and 40% RH and a sample aged in a freezer for 3 weeks. A greater value (ΔD) indicates poorer storage stability.

Evaluation of Pressure Resistance

Samples were each cut to a 35 mm lateral and 140 mm long size. Using a scratch tester (HEIDON 18-Type, produced by Shinto Kagaku Co., Ltd.), a constant load of 25 g, 30 g, 35 g, 40 g, 45 g or 50 g was applied to each sample in a darkroom, in accordance with a defined manner and then processed in process A, without being exposed to light. After processing, the load at which a yellow streak pressure mark was produced, was read. A greater load to produce the pressure mark indicates superior pressure resistance. The needle used therein was a 0.1 mm diamond needle.

Process A

| Processsing Step | Temperature | Time | Repl. Amt.* |
|---|---|---|---|
| Color developing | 38.0 ± 0.3° C. | 45 sec. | 80 ml |
| Bleach-fixing | 35.0 ± 0.5° C. | 45 sec. | 120 ml |
| Stabilizing | 30–34° C. | 60 sec. | 150 ml |
| Drying | 60–80° C. | 30 sec. | |

*Replenishing amount

Composition of processing solution is shown below.

Color developer (Tank solution, Replenisher)

| | Tank soln. | Replenisher |
|---|---|---|
| Water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N(β-methanesulfonamidoethyl)-3-methyl-4-aminoaniline sulfate | 6.0 g | 10.0 g |
| N,N-diethylhydroxyamine | 6.8 g | 6.0 g |
| Triethanolamine | 10.0 g | 10.0 g |
| Sodium diethyltriaminepentaacetate | 2.0 g | 2.0 g |
| Brightener (4,4'-diaminostilbene-disulfonate derivative) | 2.0 g | 2.5 g |
| Potassium carbonate | 30 g | 30 g |

Water is added to make 1 liter, and the pH of the tank solution and replenisher were respectively adjusted to 10.10 and 10.60 with sulfuric acid or potassium hydroxide.

Bleach-fixer (Tank solution, Replenisher)

| | |
|---|---|
| Diethylenetriaminepentaacetic acid iron (III) ammonium salt dihydrate | 65 g |
| Diethylenetriaminepentaacetic acid | 3 g |
| Ammonium thiosulfate (70% aqueous solution) | 100 ml |
| 2-Amino-5-mercapto-1,3,4-thiadiazole | 2.0 g |
| Ammonium sulfite (40% aqueous solution) | 27.5 ml |

Water is added to make 1 liter, and the pH is adjusted to 5.0.

Stabilizer (Tank solution, Replenisher)

| | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| Bismuth chloride (45% aqueous solution) | 0.65 g |
| Magnesium sulfate hepta-hydrate | 0.2 g |
| Polyvinyl pyrrolidone | 1.0 g |
| Ammonia water (25% aqueous ammonium hydroxide solution) | 2.5 g |
| Trisodium nitrilotriacetate | 1.5 g |

Water is added to make 1 liter, and the pH is adjusted to 7.5 with sulfuric acid or ammonia water.

The thus obtained results are shown blow.

| Sample No. | Image Clarity (C value) | Fingerprint Resistance | Storage Stability (ΔD) | Pressure Resisttance (g) | Remark |
|---|---|---|---|---|---|
| 101 | 70 | C | 0.010 | 30 | Comp. |
| 102 | 44 | B | 0.011 | 25 | Comp. |
| 103 | 46 | B | 0.006 | 40 | Inv. |
| 104 | 46 | A | 0.002 | 45 | Inv. |
| 105 | 47 | B | 0.002 | 45 | Inv. |
| 106 | 46 | B | 0.005 | 45 | Inv. |
| 107 | 46 | A | 0.005 | 45 | Inv. |
| 108 | 47 | B | 0.006 | 40 | Inv. |

-continued

| Sample No. | Image Clarity (C value) | Fingerprint Resistance | Storage Stability (ΔD) | Pressure Resisttance (g) | Remark |
|---|---|---|---|---|---|
| 109 | 47 | B | 0.006 | 40 | Inv. |
| 110 | 46 | B | 0.002 | 50 | Inv. |

EXAMPLE 2

Samples prepared in Example 1 were evaluated similarly, provided that the following process B was used in place of the process A.

Process B

| Processsing step | Temperature | Time | Repl. Amt.* |
|---|---|---|---|
| Color developing | 38.0 ± 0.3° C. | 22 sec. | 81 ml |
| Bleach-fixing | 35.0 ± 0.5° C. | 22 sec. | 54 ml |
| Stabilizing | 30–34° C. | 25 sec. | 150 ml |
| Drying | 60–80° C. | 30 sec. | |

*Replenishing amount

Composition of Processing Solution

Color developer (Tank solution, Replenisher)

| | Tank soln. | Replenisher |
|---|---|---|
| Water | 800 ml | 800 ml |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N(β-methanesulfonamidoethyl)-3-methyl-4-aminoaniline sulfate | 6.5 g | 10.5 g |
| N,N-diethylhydroxyamine | 3.5 g | 6.0 g |
| N,N-bis(2-sulfoethyl)hydroxylamine | 3.5 g | 6.0 g |
| Triethanolamine | 10.0 g | 10.0 g |
| Sodium diethyltriaminepentaacetate | 2.0 g | 2.0 g |
| Brightener (4,4'-diaminostilbene-disulfonate derivative) | 2.0 g | 2.5 g |
| Potassium carbonate | 30 g | 30 g |

Water is added to make 1 liter, and the pH of the tank solution and replenisher were adjusted to 10.10 and 10.60, respectively, with sulfuric acid or potassium hydroxide.

Bleach-fixer (Tank solution, Replenisher)

| | Tank soln. | Replenisher |
|---|---|---|
| Ammonium ferric diethyltriamine-pentaacetate dihydrate | 100 g | 50 g |
| diethyltriaminepentaacetic acid | 3 g | 3 g |
| Ammonium thiosulfate (70% aqueous solution) | 200 ml | 100 ml |
| 2-Amino-5-mercapto-1,3,4-thiadiazole | 2.0 g | 1.0 g |
| Ammonium sulfite (40% aqueous solution) | 50 ml | 25 ml |

Water is added to make 1 liter, and the pH is adjusted to 7.0 with potassium carbonate or glacial acetic acid.

Stabilizer (Tank solution, Replenisher)

| | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| PVP | 1.0 g |
| Ammonia water (25% aqueous ammonium hydroxide solution) | 2.5 g |
| Ethylenediaminetetraacetic acid | 1.0 g |
| Ammonium sulfite (40% aqueous solution) | 10 ml |

Water is added to make 1 liter, and the pH is adjusted to 7.5 with sulfuric acid or potassium hydroxide.

As a result of evaluation of the foregoing, it was proved that, similarly to Example 1, inventive samples were superior in image clarity, fingerprint resistance, long-term storage stability and pressure resistance to comparative samples.

EXAMPLE 3

Samples prepared in Example 1 were subjected to running process in process of CPK-2-J1 using an automatic processor, NPS-868J, produced by Konica Corp. and processing chemicals, ECO JET-P and evaluated similarly to Example 1, with respect to image clarity, fingerprint resistance, long-term storage stability and pressure resistance. As a result, it was proved that inventive samples were superior in any of characteristics to comparative samples.

EXAMPLE 4

Samples 101, 102, 108 and 109 of Example 1 were evaluated with respect to sharpness in the following manner.

Evaluation of Sharpness

Resolving power test chart was printed through red light onto each of the samples and processed in the foregoing process A. Thus obtained cyan images were subjected to densitometry using microdensitometer PDM-5D (produced by Konica Corp.) and the value represented by the following equation was defined as sharpness:

Sharpness (%)=[($D_{max}$−$D_{min}$) of closed-line print image of 3 line/mm]/[($D_{max}$−$D_{min}$) of large area]

Evaluation Result of Sharpness

Evaluation result of sharpness of each sample are as follows:

Sample 101 (Comp.): 0.680

Sample 102 (Comp.): 0.669

Sample 108 (Inv.): 0.731

Sample 108 (Inv.): 0.745

INDUSTRIAL APPLICABILITY

According to the constitution of the present invention, there can be provided a silver halide photographic material having a paper support which is coated with resin coat layers on both sides of a base paper, and in particular, to a silver halide photographic material exhibiting superior glossiness and improved sharpness, long-term stability, fingerprint resistance and pressure resistance.

What is claimed is:

1. A silver halide photographic material comprising on one side of a paper support having resin coat layers on both sides of a base paper one or more light-sensitive layers and one or more light-insensitive layers, wherein after the photographic material of an L-size (having a length of 89 mm in a machine direction of the base paper and a length of 127 mm vertical to the machine direction) is processed, the photographic material exhibits an image clarity (C-value) of 20% to 60% which is determined using a 1.0 mm optical wedge in accordance with JIS K 7105; and the photographic material comprising a light-insensitive hydrophilic colloid layer between a light-sensitive layer closest to the support and the support, the light-insensitive hydrophilic colloid layer containing a mercapto-heterocyclic compound.

2. The silver halide photographic material as claimed in claim 1, wherein the light-insensitive hydrophilic colloid layer contains a thiosulfonic acid compound.

3. The silver halide photographic material as claimed in claim 1, wherein the light-insensitive hydrophilic colloid layer contains a latex.

4. The silver halide photographic material as claimed in claim 1, wherein the light-insensitive hydrophilic colloid layer contains a lipophilic compound dispersion.

5. The silver halide photographic material as claimed in claim 1, wherein the light-insensitive hydrophilic colloid layer contains a titanium oxide.

6. The silver halide photographic material as claimed in claim 1, wherein the light-insensitive hydrophilic colloid layer contains a colloidal silver.

7. The silver halide photographic material as claimed in claim 1, wherein the light-sensitive layer closest to the support is a blue-sensitive layer containing silver halide grains having an average grain size of 0.35 to 0.60 μm.

8. The silver halide photographic material as claimed in claim 2, wherein the light-sensitive layer closest to the support is a blue-sensitive layer containing silver halide grains having an average grain size of 0.35 to 0.60 μm.

9. The silver halide photographic material as claimed in claim 3, wherein the light-sensitive layer closest to the support is a blue-sensitive layer containing silver halide grains having an average grain size of 0.35 to 0.60 μm.

10. The silver halide photographic material as claimed in claim 4, wherein the light-sensitive layer closest to the support is a blue-sensitive layer containing silver halide grains having an average grain size of 0.35 to 0.60 μm.

11. The silver halide photographic material as claimed in claim 5, wherein the light-sensitive layer closest to the support is a blue-sensitive layer containing silver halide grains having an average grain size of 0.35 to 0.60 μm.

12. The silver halide photographic material as claimed in claim 6, wherein the light-sensitive layer closest to the support is a blue-sensitive layer containing silver halide grains having an average grain size of 0.35 to 0.60 μm.

13. A silver halide photographic material comprising on one side of a paper support having resin coat layers on both sides of a base paper one or more light-sensitive layers and one or more light-insensitive layers, wherein after the photographic material of an L-size (having a length of 89 mm in a machine direction of the base paper and a length of 127 mm vertical to the machine direction) is processed, the photographic material exhibits an image clarity (C-value) of 20% to 60% which is determined using a 1.0 mm optical wedge in accordance with JIS K 7105; and the photographic material comprising a light-insensitive hydrophilic colloid layer between a light-sensitive layer closest to the support and the support and the light-insensitive hydrophilic colloid layer containing a mercapto-heterocyclic compound and wherein the light-sensitive layer closest to the support is a blue-sensitive layer contains silver halide grains having an average grain size of 0.35 to 0.60 μm.

* * * * *